United States Patent [19]

Peham

[11] 3,986,211

[45] Oct. 19, 1976

[54] TRICORN HAT

[76] Inventor: Engelbert J. Peham, 1263 Donohue Ave., St. Paul, Minn. 55104.

[22] Filed: June 30, 1975

[21] Appl. No.: 591,874

Related U.S. Application Data

[63] Continuation of Ser. No. 498,099, Aug. 16, 1974, abandoned.

[52] U.S. Cl. ..... 2/175

[51] Int. Cl.[2] ..... A42B 1/00

[58] Field of Search ..... 2/175, 195, 183, 172, 2/192, 177, 196, 171; D2/258, 251, 250

[56] References Cited

UNITED STATES PATENTS

| | | | |
|---|---|---|---|
| 766,419 | 8/1904 | Breck et al. | 2/195 |
| 1,242,964 | 10/1917 | Mitchell | D2/258 X |
| 1,330,299 | 2/1920 | Ballard | 2/175 X |
| 1,636,889 | 7/1927 | Wittcoff | 2/175 |

*Primary Examiner*—G. V. Larkin

[57] ABSTRACT

A simulated tricorn hat is produced including a body of thin plastic, including a brim, a riser and a crown. The brim is designed to flex against the riser of the hat near the crown at three generally equally spaced points. Means are provided on the brim to extend through apertures in the riser to hold the brim against the riser at the three equally spaced points.

5 Claims, 9 Drawing Figures

TRICORN HAT

This application is a continuation of application Ser. No. 498,099, filed Aug. 16, 1974 and now abandoned.

This invention relates to an improvement in simulated tricorn hats and deals particularly with a type of hat which is generally triangular in shape.

BACKGROUND OF THE INVENTION

Hats having brims of generally triangular shape were worn during the lifetime of George Washington, our first president. A simulated hat of this type, made of plastic, has become popular on special occasions such as conventions and the like where the wearers want some sort of symbol to identify themselves. However, in order to be practical, formed of plastic molding, the hats must be molded with brims which are flat and are somewhat curved upwardly, and must be provided with connecting means for securing the brim to the crown of the hat at three spaced points, in order to provide the desired appearance.

Obviously, excessive space is required to ship hats of the type described in volume, as they are actually given away or sold at a very low price for the purpose they are intended to accomplish.

The applicant and his firm have produced various types of hats from plastic material. For example, U.S. Pat. No. 3,765,030 shows a type of skimmer hat simulating a straw hat, this type of hat has been produced by the hundreds of thousands, the main difference being in the hat bands which usually provide an indication of the organization using the hats. This patent was preceded by U.S. Pat. No. 3,305,874 which was also a skimmer type hat having a hat band or internal resilient cord which made the hat adaptable to heads of various sizes. The present invention also comprises a novelty type of hat, but simulates the hats worn during the early days of the United States.

SUMMARY OF THE INVENTION

The present invention resides in the provision of a hat formed of thin plastic material, and having a brim which is shaped in such a manner that numerous hats may be nested together, and shipped and delivered in nested form. The main point of difference lies in the fact that the periphery of the brim is provided with three tongues which are designed to extend into slits in the crown of the hat. Accordingly, in order to complete the assembly of the hat, it is only necessary to insert these three tongues into the slits in the hat crown so as to hold three portions of the hat brim to the crown, and producing a result similar to that accomplished by the tricorn hat used many years ago.

These and other objects and novel features of the present invention will be more fully and clearly set forth in the following specification and claims.

DESCRIPTION OF THE PREFERRED EMBODIMENTS

Figure 2:
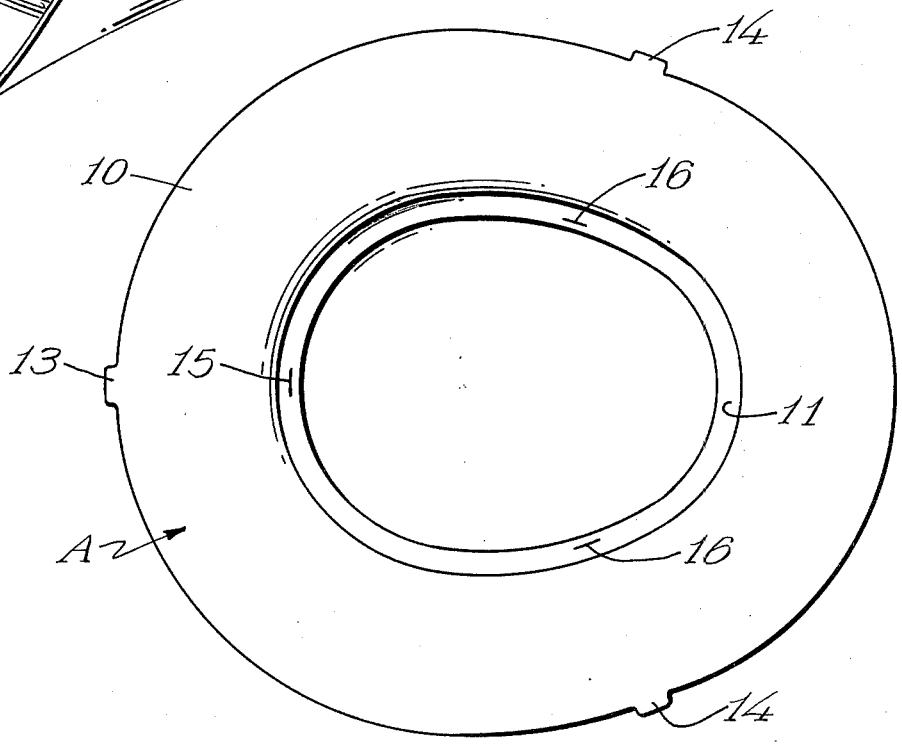
FIG. 2 is a top plan view of the hat with the brim extended.

The hat which is indicated in general by the letter A, is designed to represent a tricorn hat of the type used approximately during the days of the Revolutionary War. The hat is made of thin flexible plastic material and includes a brim 10 which is of generally oval shape as indicated in FIG. 2 of the drawings, and includes the usual riser 11 and crown 12. The main point of difference between this and a normal hat possessing the same elements, is indicated in FIG. 2 of the drawings, where a short projection or ear 13 projects from the front of the hat and similar ears 14 project from opposite sides of the brim 10. The spacing between the ears 13 and 14 is generally similar to the distance between the rearmost ears 14 as indicated. The riser 11 is provided with a slot or slit 15 which is designed to accommodate the ear 13 at the front of the hat, and a pair of slits 16 which extend through the crown of the hat designed to accommodate the ears 14. When the ears 13 and 14 are engaged in the slits or slots 15 and 16 respectively, three points of the brim which are approximately equal distance apart, are engaged with the riser 11 near the crown 12 of the hat, and produce the appearance of the tricorn hat shown in the drawings.

Figure 1:
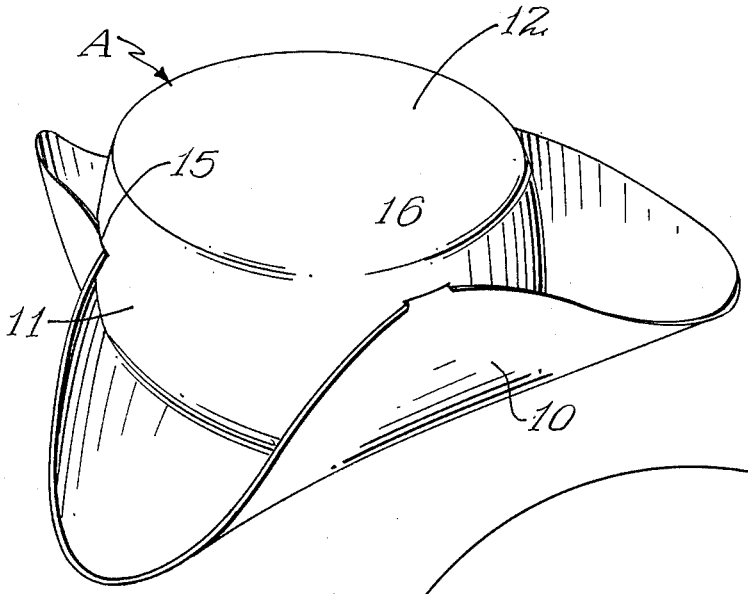
FIG. 1 is a perspective view of the tricorn hat in readiness for use.
Figure 4:
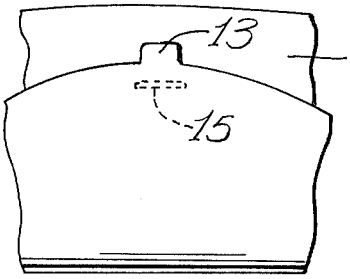
FIG. 4 is a side elevation view of a portion of the hat showing the attaching tongue, and the slot into which the tongue is extended.
Figure 7:
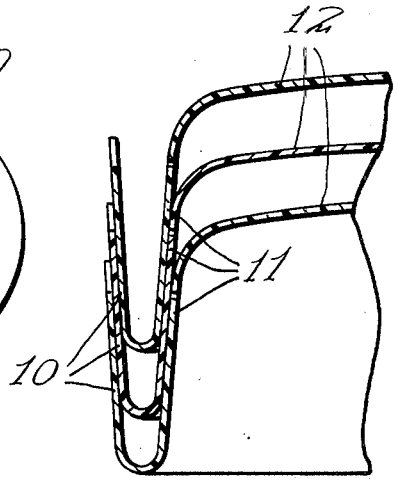
FIG. 7 is a cross sectional view of a series of hats in superimposed relation.

The hats are molded so that portions of the brim indicated at 17 and 19 extend upwardly as indicated in FIG. 7 of the drawings. When in this position, the hat A has the general appearance of a tricorn hat, but due to the flexibility of the plastic employed, the brims have a tendency to flatten out. After the hats are molded, the hats are placed between three vertical dowels such as 20 which tend to hold the various hats in their regular tricorn shape. As shown in FIG. 4 of the drawings the slits or slots 15 are located in the riser 11 somewhat below the natural level of the ears 13. However, in order to maintain the proper shape of the hat, each of the ears 13 is inserted through the slot or slit 15, the three ears 13 holding the brim 10 engaged with the riser 11, and holding the brim securely attached to the riser, thus producing the tricorn shape illustrated in FIG. 1 of the drawings.

Figure 3:
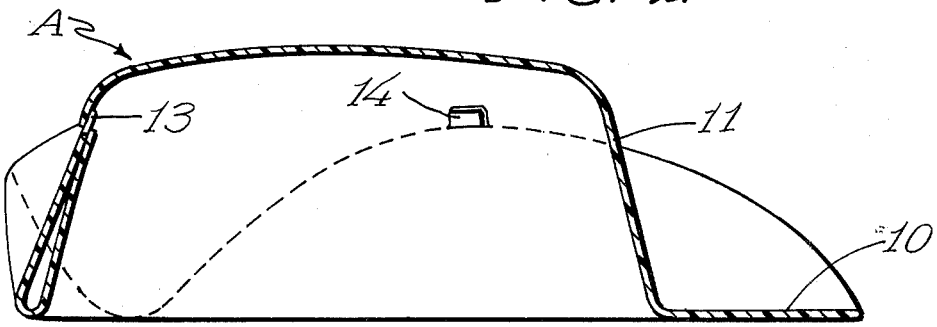
FIG. 3 is a sectional view longitudinally through the hat showing the construction thereof.
Figure 5:
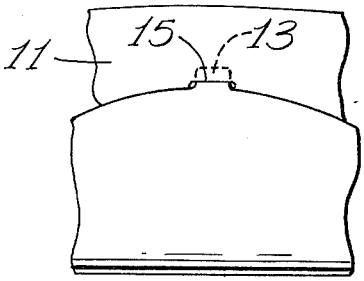
FIG. 5 is a view similar to FIG. 4 showing the tongue after it has been inserted into the aperture.
Figure 6:
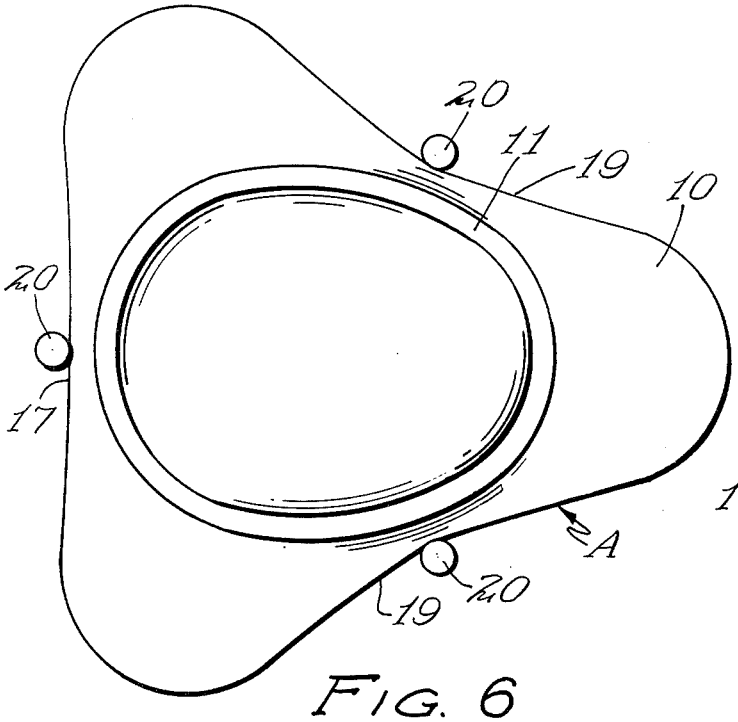
FIG. 6 is a top plan view showing the hat between three vertical dowel pins, the dowel pins being intended to indent the three sides of the hat so that it will be in proper form when shipped.

The positioning of the slits or slots 15 below the upper extremity of the ears 13 is of importance, as the brim 10 must be flexed downwardly in order to insert the ear in each of the slots 15. FIGS. 4 and 5 of the drawings show slots designed to accommodate the ears, but in the actual practice, slits thorough the thin plastic material accomplish much the same result as somewhat wider slots. Once the ears 13 and 14 have been engaged in the slits or slots 15 or 16, the appearance of the hat is similar to that shown in the drawings. The flat portion of the brim 10 which extends to the right in FIGS. 1 and 3 of the drawings usually forms the front of the hat, and extends forwardly as the visor to protect the vision of the wearer.

Figure 9:
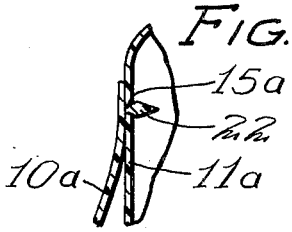
FIG. 9 is a sectional view through a modified form of construction.
Figure 8:
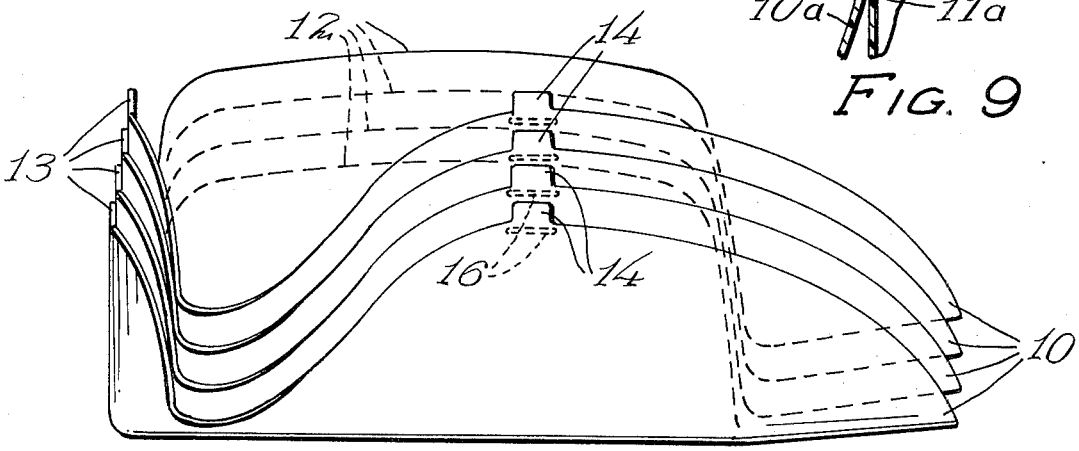
FIG. 8 is a side elevational view of a series of hats in superimposed relation.

FIG. 9 of the drawings discloses a modified form of construction in which the riser 11*a* is provided with a slit or slot such as 15*a* to include a prong 22 which extends therethrough in order to hold the brim 10*a* engaged with the riser 11*a*. However, in view of the fact that this construction is somewhat more difficult to mold, the projecting ears 13 and 14 are the preferable form of construction.

In accordance with the Patent Statutes, I have described the principles of construction and operation of my Tricorn Hat, and while I have endeavored to set forth the best embodiments, I desire to have it understood that obvious changes may be made within the scope of the following claims without departing from the spirit of my invention.

I claim:

1. A simulated tricorn hat comprising:

a body of thin plastic material including a brim, a riser, and a crown, three apertures in said riser near the crown parallel to said brim thereof, one said aperture being at the rear of the crown, and the other two being spaced on either side of the front of the crown, said apertures being generally evenly spaced, means on said brim engageable in said apertures to hold three spaced areas of said brim against said riser near said crown.

2. The hat of claim 1 and in which said apertures comprise slits.

3. The structure of claim 2 and in which said apertures comprise slits extending horizontally.

4. The structure of claim 3 and in which said means on said brim comprise tongues projecting from the marginal edge of said brim.

5. The structure of claim 3 and in which said means on said brim comprise pointed projections extending through said slits.

* * * * *